US009145626B2

(12) United States Patent
Müller

(10) Patent No.: US 9,145,626 B2
(45) Date of Patent: Sep. 29, 2015

(54) COMBING ELEMENT FOR A CIRCULAR COMB OF A COMBING MACHINE

(71) Applicant: Graf + Cie AG, Rapperswil (CH)

(72) Inventor: Urs Müller, Euthal (CH)

(73) Assignee: Graf + Cie AG, Rapperswil (CH)

( * ) Notice: Subject to any disclaimer, the term of this patent is extended or adjusted under 35 U.S.C. 154(b) by 286 days.

(21) Appl. No.: 13/860,057

(22) Filed: Apr. 10, 2013

(65) Prior Publication Data

US 2013/0263408 A1 Oct. 10, 2013

(30) Foreign Application Priority Data

Apr. 10, 2012 (CH) ..... 490/12

(51) Int. Cl.
*D01G 19/10* (2006.01)
*D01G 15/92* (2006.01)
*D01G 15/88* (2006.01)

(52) U.S. Cl.
CPC ..... *D01G 19/105* (2013.01); *D01G 15/88* (2013.01); *D01G 15/92* (2013.01)

(58) Field of Classification Search
CPC ..... D01G 15/84; D01G 15/88; D01G 15/92; D01G 19/10; D01G 19/105
USPC ..... 19/114; D15/78
See application file for complete search history.

(56) References Cited

U.S. PATENT DOCUMENTS 2,175,131 A * 10/1939 Schwartz ..... 19/97
3,685,101 A * 8/1972 Egerer ..... 19/129 R
4,356,597 A 11/1982 Graf
4,394,789 A * 7/1983 Egerer ..... 19/97
4,516,292 A * 5/1985 Quay ..... 19/112
4,606,095 A * 8/1986 Egerer ..... 19/97
4,716,629 A * 1/1988 Iwata et al. ..... 19/114
5,109,574 A * 5/1992 Eichenberger ..... 19/234
5,894,637 A * 4/1999 Graf ..... 19/115 R
6,423,424 B1 * 7/2002 Haarer ..... 428/592
2001/0007331 A1 * 7/2001 Iwago et al. ..... 228/163
2010/0001044 A1 * 1/2010 Weibling et al. ..... 228/164
2012/0030907 A1 2/2012 Henninger

FOREIGN PATENT DOCUMENTS

CH 654341 A5 * 2/1986 ..... D01G 15/88
DE 33 36 876 A1 4/1985
WO WO 2009/003771 A1 1/2009

* cited by examiner

*Primary Examiner* — Shaun R Hurley

(74) *Attorney, Agent, or Firm* — Dority & Manning, P.A.

(57) ABSTRACT

The invention relates to combing element for a circular comb of a combing machine that is connectable to a base body of the circular comb via fastening means. The combing element has a plurality of adjacently situated clothing elements oriented transversely with respect to the longitudinal direction of the combing element and provided with a toothed clothing. The combing element has a mounting bar with a supporting surface on which the clothing elements rest. The ends of the clothing elements protrude beyond the lateral faces of the mounting bar adjoining the supporting surface, and the clothing elements are joined to the mounting bar by means of at least one weld seam applied between the base surfaces of the ends of the clothing elements that protrude beyond the supporting surface of the mounting bar and the mounting bar.

18 Claims, 3 Drawing Sheets

Prior Art

COMBING ELEMENT FOR A CIRCULAR COMB OF A COMBING MACHINE

FIELD OF THE INVENTION

The invention relates to a combing element for a circular comb of a combing machine, which is connectable to a base body of the circular comb via fastening means. The combing element has a plurality of adjacently situated clothing elements that are oriented transversely with respect to the longitudinal direction of the combing element and provided with a toothed clothing. The invention further relates to a circular comb having multiple combing elements situated one behind the other.

BACKGROUND

In practice, designs are known in which the combing elements for a circular comb are composed of multiple toothed segments that are provided with a toothed clothing and held together by longitudinal bolts. The longitudinal bolts protrude into boreholes provided in the toothed segments. Such a design is disclosed in DE 33 36 876 A1, for example. Multiple combing elements (also referred to as bars) situated one behind the other form a toothed segment having a closed comb surface. In the cited example, the toothed segments are provided with a dovetailed recess by means of which they are connected to a base body of the circular comb via a retaining element. The retaining element is provided with a corresponding dovetailed counter-profile via which it engages with the recess in the toothed segments and is held in a recess in the base body via a screw connection. In this design, additional bolts are necessary to hold the toothed segments together; in addition, a special punch is necessary to produce the dovetailed recess in the toothed segments.

Furthermore, a design is known from DE 10 2009 018 058 A1 in which combing elements are likewise disclosed, having multiple adjacently situated toothed segments held together by longitudinal bolts. In contrast to the design in cited DE 33 36 876 A1, the combing elements are fastened by means of a retaining element engages with a T-shaped recess in a base body of a circular comb via a correspondingly formed base area, and is held in the installed position via clamping and spring elements.

WO 2009/003771 A1 discloses a design of a circular comb in which multiple combing elements situated one behind the other are fastened to a base body of a circular comb. The individual combing elements have multiple adjacently situated toothed segments with base surfaces that rest on a retaining element, and which form a comb segment with a closed comb surface. The retaining element is provided with lateral webs by means of which the toothed segments are held on the retaining element. For fastening the toothed segments to the retaining element, the webs are pressed against a dovetailed base part of the toothed segments using specialized devices, and are thus fixedly clamped to the retaining element. The respective retaining element has a dovetailed section via which it is held in a correspondingly formed recess in the base body of the circular comb. In addition, the retaining elements are fixed in the recess in the base body via screw connections. In the disclosed design, no additional longitudinal bolts are necessary in order to brace the toothed segments against one another. However, a specialized device is necessary to securely clamp the toothed segments to the base body. In addition, a special design of the base body is necessary in order to achieve the clamping effect.

SUMMARY OF THE INVENTION

An object of the invention is to avoid the disadvantages of known designs, and to allow the manufacture of combing elements which are inexpensive and easy to install. Objects and advantages of the invention are set forth in part in the following description, or may be obvious from the description, or may be learned through practice of the invention.

To achieve certain objects, it is proposed that the combing element has a mounting bar with a supporting surface on which the clothing elements rest with their base surfaces opposite from the toothed clothing, and, viewed in the longitudinal direction of the clothing elements, the ends of the clothing elements protrude beyond the lateral faces of the mounting bar adjoining the supporting surface. The clothing elements are joined to the mounting bar by means of at least one weld seam applied between the base surfaces of the ends of the clothing elements which protrude beyond the supporting surface of the mounting bar and the mounting bar.

Simple and cost-effective manufacture of the combing elements is thus possible, the individual clothing elements being easily lined up next to one another on a supporting surface of a mounting bar in order to subsequently fasten the clothing elements to the mounting bar by means of at least one weld seam extending in the longitudinal direction of the mounting bar. As a result of the claimed protrusion of the ends of the clothing elements beyond the supporting surface of the mounting bar, it is possible to apply a weld seam for fastening the clothing elements in such a way that the weld seam does not adversely affect the lining up of multiple combing elements in sequence, and a continuous comb surface, viewed in the peripheral direction of the circular comb, is ensured.

In published CH-644 900, a flat of a card is disclosed, wherein adjacently situated clothing elements (wire strips) are mounted on a supporting surface of a carrier part and fastened by means of weld seams. The ends (end faces) of the clothing elements are aligned with the outer faces of the carrier part. The weld seams are applied in the area of the transition from the supporting surface of the carrier part to the outer faces of the carrier part, and are intended to align with the end faces of the clothing elements and the outer faces in order to be able to connect an adjacent flat at the smallest possible distance. The disclosed design is not a combing element for a circular comb in which even a small distance between the successive combing elements can impair the combing effect. As a result of the proposed projection of the ends of the clothing elements beyond the lateral faces of the mounting bar in accordance with the present invention, the particular weld seam may be applied without influencing the distance between adjacent mounting bars, and in addition no special precautions have to be taken so that the particular weld seam is aligned with the ends (end faces) of the clothing elements and the lateral faces of the mounting bar (carrier part).

This means that the protruding ends of the clothing elements of adjacent combing elements of a circular comb may directly abut one another without a distance between them, thus forming a closed comb surface.

Furthermore, it is proposed that a weld seam is provided between the base surfaces of both ends of the clothing elements, which protrude beyond the supporting surface of the mounting bar, and the mounting bar. A design would be conceivable in which the clothing elements are connected only at their one end to the mounting bar by means of a weld seam. At the opposite end, the clothing elements could be fastened to the mounting bar by means of an additional adhesive connection. However, an absolute fixed connection between the clothing elements and the mounting bar is ensured when, in each case, a weld seam is applied in the area of both ends of the clothing elements.

The weld seam is advantageously continuous, and may be produced by laser welding.

Using the proposed laser welding, operations may be carried out at a high welding speed, and a narrow, thin weld seam shape with low thermal distortion may be produced.

To be able to quickly and easily join the mounting bar and the clothing elements connected thereto to the base body of the circular comb, it is proposed that on the opposite side of its supporting surface for the clothing elements, the mounting bar has a mounting profile which together with a receptacle provided in the base body of the circular comb may establish an at least partial positive-fit connection.

It is preferably proposed that the mounting profile has a dovetail-shaped cross section. Thus, by means of the mounting profile of the mounting bar, a positive-fit connection may be established with an identically shaped recess, viewed in the cross section, in the base body of a circular comb.

In another embodiment for fastening the combing element to the base body of the circular comb, it is proposed that the mounting bar is provided with a longitudinal groove on the opposite side of the supporting surface for the clothing elements, which is able to establish an at least partial positive-fit connection with a fastening means. The longitudinal groove may have a dovetail-shaped cross section.

The invention further relates to a circular comb of a combing machine, having a base body on which multiple combing elements are situated one behind the other, viewed in the direction of rotation of the circular comb, and are mounted via fastening means. The particular combing elements have a plurality of adjacently situated clothing elements, oriented transversely with respect to the longitudinal direction of the combing element, which are provided with a toothed clothing.

It is proposed that the combing elements in each case have a mounting bar with a supporting surface on which the clothing elements rest with their base surfaces opposite from the toothed clothing, and, viewed in the longitudinal direction of the clothing elements, the ends of the clothing elements protrude beyond the lateral faces of the particular mounting bar adjoining the supporting surface. The mutually facing ends of the clothing elements of adjacent combing elements directly adjoin one another, and the clothing elements are connected to the particular mounting bar by means of at least one weld seam. The weld seam is applied between the base surfaces of the ends of the clothing elements protruding beyond the supporting surface of the mounting bar, and the mounting bar.

It is thus possible to mount the adjoining combing elements or their clothing element without a distance between them in order to obtain a closed comb surface.

It is proposed that a weld seam is provided between the base surfaces of both ends of the clothing elements of the respective combing element that protrude beyond the mounting bar, and the mounting bar.

The weld seams may in each case extend continuously in the longitudinal direction of the mounting bar, and may be produced by laser welding.

For easily fastening the combing elements to the circular comb, it is proposed that the mounting bar has a mounting profile on the opposite side of the clothing elements, which may establish at least a partial positive-fit connection with a receptacle provided in the base body of the circular comb. The mounting profile may have a dovetail-shaped cross section.

The circular comb according to the invention is preferably used in a combing machine.

The invention further relates to a circular comb of a combing machine having a base body to which multiple combing elements situated one behind the other, viewed in the direction of rotation of the circular comb, are fastened, and which together form a comb segment having a closed comb surface. The particular combing element are formed from a plurality of adjacently situated clothing elements oriented transversely with respect to the direction of rotation of the circular comb.

It is proposed according to the invention that the particular clothing elements, which with their base surfaces rest on the base body, are connected to the base body in the area, viewed in the longitudinal direction of the clothing elements, of at least one of their ends by means of a weld seam extending transversely with respect to the longitudinal direction of the clothing elements. The mutually facing ends of the clothing elements are provided with an offset in such a way that these ends overlap one another in a stepped manner, viewed in the radial direction of the circular comb, and form a closed clothing surface between the adjacent clothing elements.

It is thus possible to fasten the particular clothing elements, which adjoin a first clothing element, to the base body by means of only one weld seam in each case. The clothing element is held at the opposite end of the weld seam by the stepped overlap of the adjacent clothing element.

A design is proposed in which only one weld seam is provided in the area of the overlap, by means of which the end of the particular clothing element that is provided with an offset, viewed in the radial direction of the circular comb, and which outwardly protrudes beyond the offset of the clothing element of the adjacent combing element, is connected to the base body with a distance being provided between the stepped ends of adjacent clothing elements in the area of the weld seam.

BRIEF DESCRIPTION OF THE DRAWINGS

Further advantages of the invention are illustrated and described in the following exemplary embodiments. The figures show the following.

DETAILED DESCRIPTION

Figure 1:
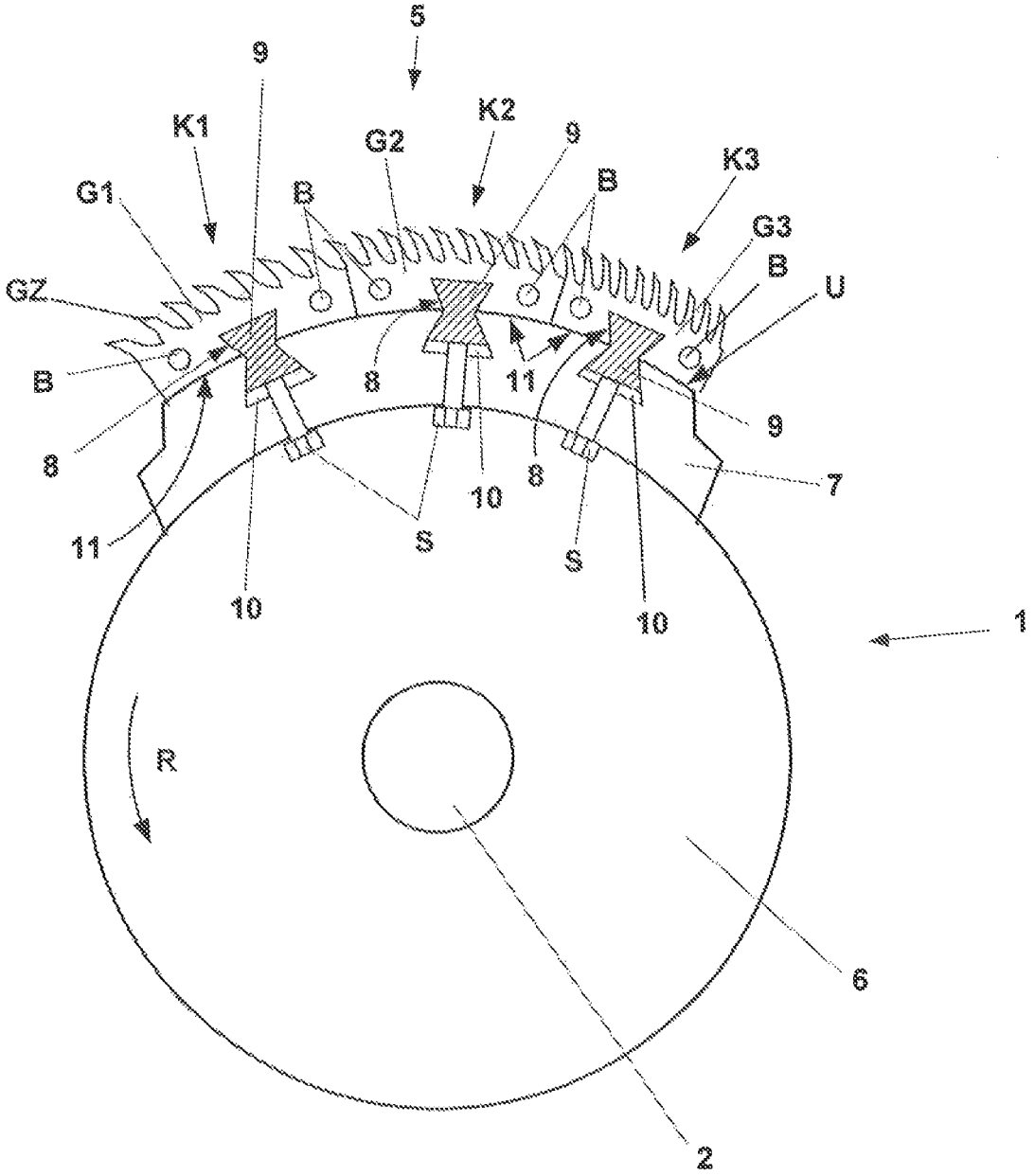
FIG. 1 shows a schematic side view of a circular comb according to the known prior art.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

FIG. 1 shows a known design of a circular comb 1 of a combing machine having a circular comb shaft 2. A base body 7 bearing a comb segment 5 is fastened to flanges 6 mounted on the circular comb shaft 2 in a rotationally fixed manner.

The base body 7 may also be directly fastened to the shaft 2. In the design shown, the comb segment 5 is composed of multiple combing elements K1, K2, and K3, (also referred to as bars) situated one behind the other viewed in the combing direction R, which in each case are composed of a plurality of adjacently situated clothing elements G1, G2, and G3, respectively. As schematically shown, viewed opposite the combing direction R, the clothing elements G2 of the combing element K2 subsequent to the front clothing elements G1 of the combing element K1, and the clothing elements G3 of the combing element K3 subsequent to the combing element K2, in each case have a greater number of clothing teeth GZ per unit length, thus enhancing the combing effect.

Figure 4:
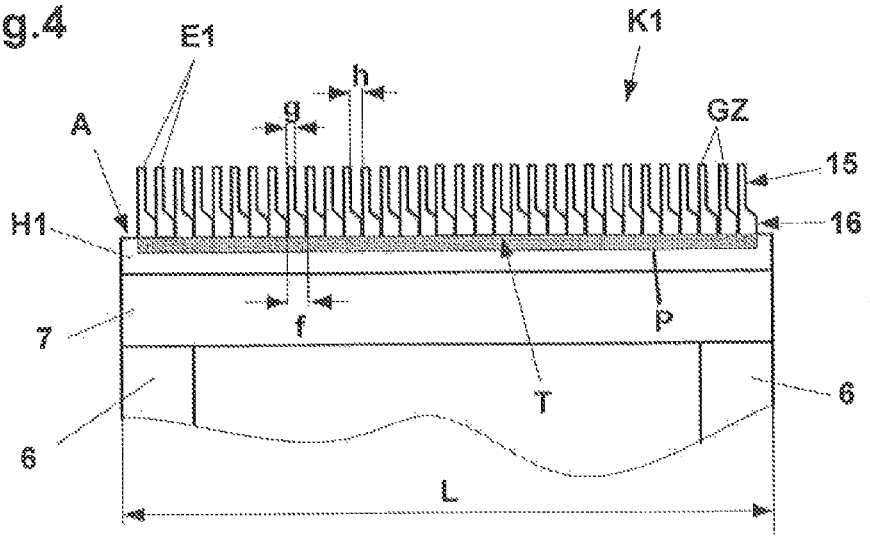
FIG. 4 shows a side view X according to FIG. 2.

As described above, a comb segment (K1, for example) is composed of a plurality of adjacently situated clothing elements (punched parts) which are held together and braced against one another by schematically shown bolts B. For this purpose, each clothing element G1 through G3 is provided with two boreholes through which the bolts protrude. At their ends the bolts B are provided with threads (not shown) by means of which the clothing elements G1, G2, and G3 are braced together using nuts (not shown). In the installed state of the clothing elements, the individual clothing teeth are spaced apart at a lateral distance, viewed transversely with respect to the combing direction R, as shown in the view according to FIG. 4.

The combing elements K1 through K3 held together by means of the bolts B are in each case then connected by means of a dovetailed web 9 to the base body 7, which is provided with corresponding recesses 10 having the identical shape. The clothing elements G1 through G3 likewise have dovetailed recesses 8 by means of which the respective web 9 may establish a positive-fit connection.

In order to hold the combing elements K1 through K3 in their installed position (as shown), the webs are fixed to the base body 7 via schematically indicated screws S. The webs 9 may be provided with threaded holes (not shown) into which the screws S protrude. In the installed state, the clothing elements G1 through G3 rest with their respective base surfaces 11 on the circumferential surface U of the base body 7.

Figure 2:
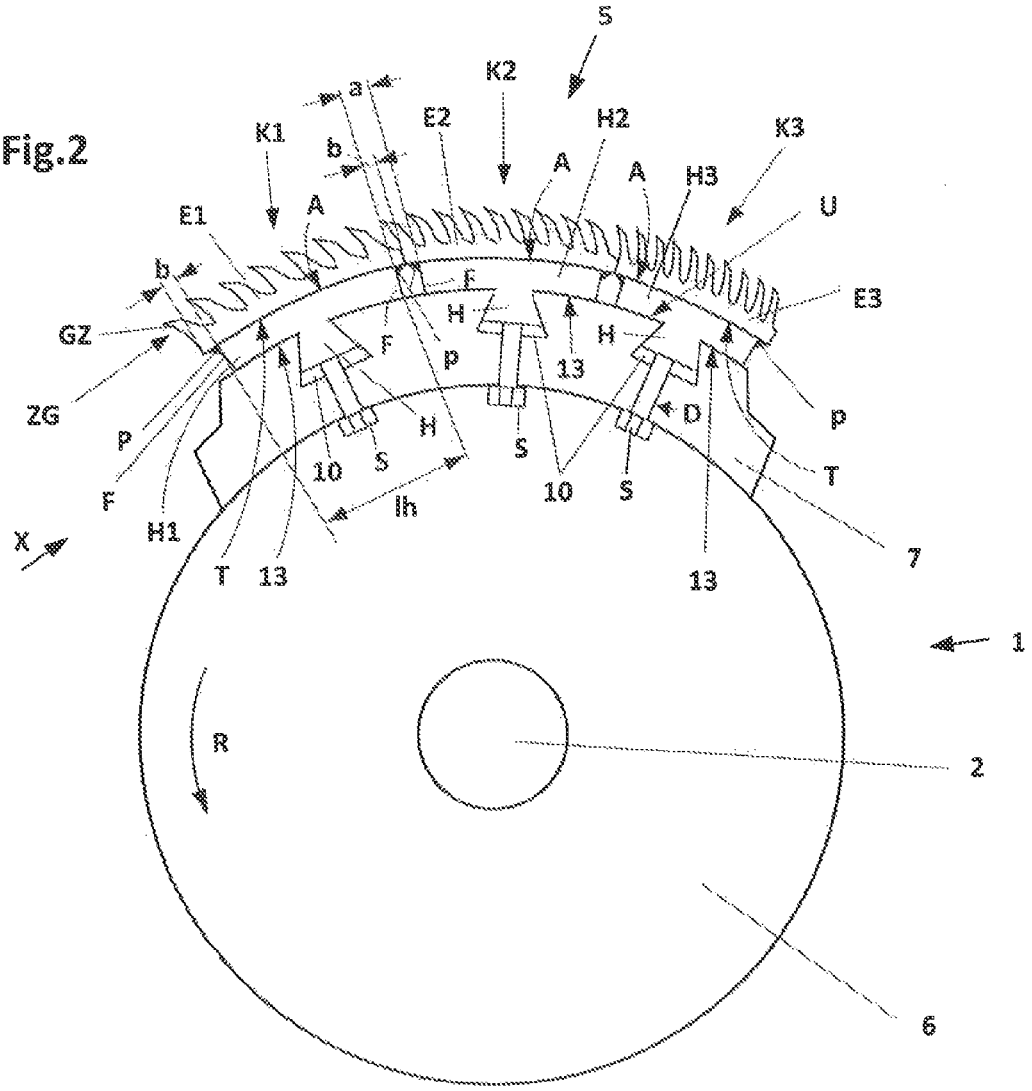
FIG. 2 shows a schematic side view of a circular comb, having another design according to the invention of the combing elements of a comb segment.

FIG. 2 shows an embodiment of the invention in which the circular comb 1 is likewise composed of a circular comb shaft 2, a base body 7 being fastened to flanges 6 which are fixedly connected to the circular comb shaft 2. Here as well, a design is conceivable in which the base body is fastened directly to the circular comb shaft 2.

The base body 7 has multiple recesses 10, situated at a distance behind one another viewed in the combing direction R, which have a dovetail-shaped cross section. These recesses 10 accommodate a mounting profile H of a mounting bar H1, H2, H3, respectively, which is provided with a corresponding mirror-image cross-sectional profile, and which thus establishes a positive-fit connection with the respective recess 10. The mounting bars H1 through H3 extend over the width L (FIG. 4) of the circular comb 1. In the installed state, the mounting bars H1 through H3 rest with their base surfaces 13 on the circumferential surface U of the base body 7. In this position, the mounting bars are fixed to the base body 7 via screws S. Each screw S may protrude into the respective recess 10 through openings D (boreholes) in the base body 7, and may establish a mechanical connection with the mounting profile H via threaded holes in the mounting profile (not shown in greater detail). The respective base surface 13 of the mounting bars H1 through H3 is then clamped against the circumferential surface U of the base body 7 via the respective screws S. In the installed position, the mutually facing lateral faces F of the successive mounting bars H1 through H3 (viewed in the combing direction R) are separated from one another by a distance "a".

Adjacently situated clothing elements E1, E2, and E3 having toothed clothings ZG with clothing teeth GZ are fastened to the supporting surface A of the mounting bar H1, H2, and H3, respectively. As is apparent from FIG. 4 (view X according to FIG. 2), the adjacently situated clothing elements E1 of the first combing element K1 in each case have a base area 16, and a head area 15 joined thereto which forms the tooth tip of the particular clothing tooth GZ of the toothed clothing ZG. The adjacently situated base areas 16 have a thickness "f", while the head areas 16 have a thickness "g" which is less than that of the base areas. Channels having a width "h" are formed, into which the fiber material to be combed may penetrate during the combing process.

Viewed with reference to the width "lh" (FIG. 2) of the respective mounting bar H1, H2, and H3, the clothing elements E1, E2, and E3, respectively, protrude beyond the respective lateral face F by a projection dimension "b". The ends, which protrude by the dimension b, of directly adjacent clothing elements E1 through E3 directly adjoin one another without a large space in between, resulting in a closed comb surface. A minimum distance between the adjoining ends may be present, for example to compensate for tolerances.

In the area of the ends of the clothing elements E1 through E3 which protrude beyond the lateral face F of the respective mounting bar, a weld seam P which extends in the longitudinal direction L of the mounting bars is applied beneath the respective base surface T of the clothing elements. The weld seams P are in each case joined to the base surface T of the clothing elements E1, E2, and E3, and to the respective lateral face F. The weld seams may preferably be produced by laser welding.

As a result of the proposed application of the weld seam in connection with the protruding ends of the clothing elements, it is possible to directly connect the adjacent ends of the clothing elements to one another without the comb surface being interrupted. This means that the connection of the clothing elements to the particular mounting bar via a welded connection has no influence on the direct, seamless sequential lining up of the clothing elements for forming a closed comb surface. If a welded connection were provided at the described location without protruding ends of the clothing elements, the weld seams could possibly hinder the direct sequential lining up of the clothing elements. Due to the design proposed according to the invention, the particular welded connection may be easily and quickly applied without taking dimensional specifications into account. Furthermore, as a result of this type of fastening, the use of additional bolts, by means of which the clothing elements according to known designs are held together, may be dispensed with.

Figure 3:
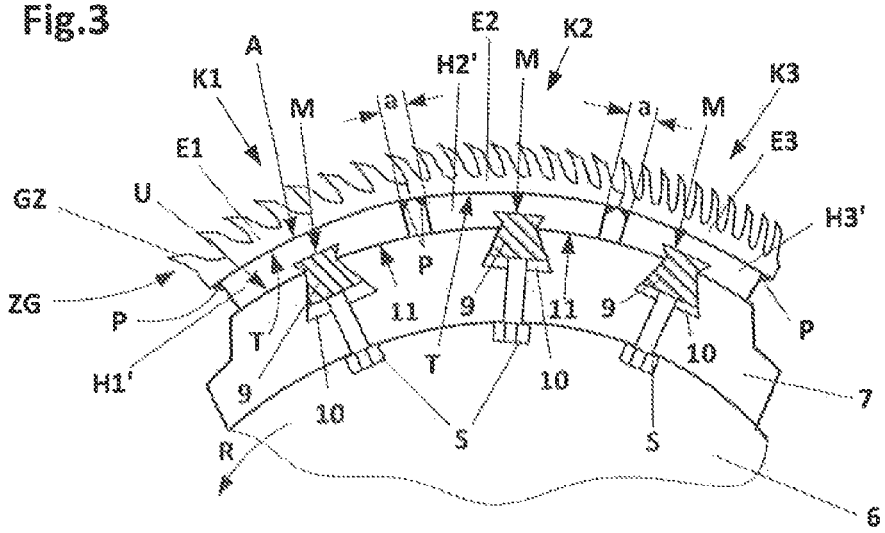
FIG. 3 shows a partial view according to FIG. 2 having a further design according to the invention of the combing elements.

FIG. 3 shows another embodiment in which, instead of a mounting profile (H), the individual mounting bars H1', H2', and H3' are in each case provided with dovetailed recesses M into which a web 9 provided with a corresponding counter-profile protrudes. At the same time, in the installed position the web 9 protrudes into a dovetailed recess 10 in the base body 7 and forms a positive-fit connection with same. The respective web 9 is fixed by means of screws S as described in the exemplary embodiment in FIG. 1, and the respective base surface 11 of the mounting bars is pressed against the circumferential surface U of the base body. The clothing elements E1 through E3 are likewise attached to the mounting bars H1' through H3', respectively, by means of weld seams P as described in the exemplary embodiment in FIG. 2. The same advantages as described in conjunction with the exemplary embodiment in FIG. 2 are achieved by the design of the example shown in FIG. 3.

Figure 5:
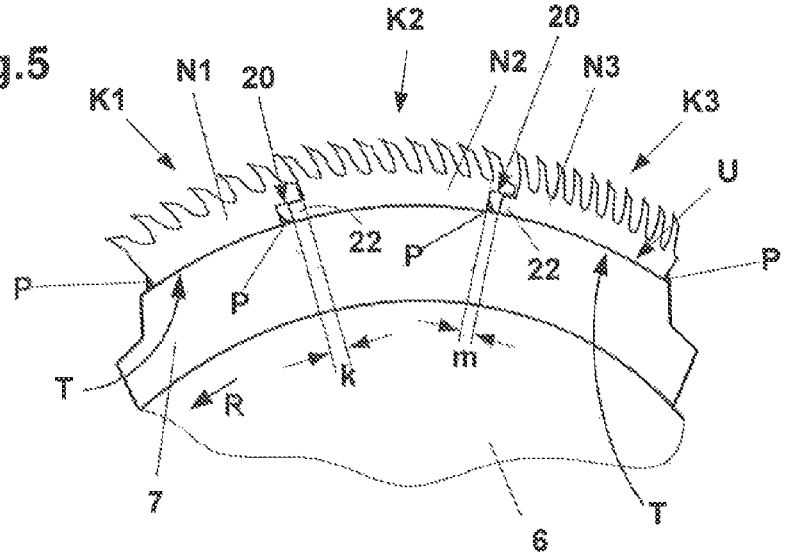
FIG. 5 shows another exemplary embodiment of a fastening of the combing elements by means of a welded connection at the base body of the circular comb.

In the exemplary embodiment in FIG. 5, a type of fastening is likewise proposed in which the respective clothing elements N1, N2, N3, having toothed clothings ZG of the combing elements K1 through K3 situated one behind the other, are fastened directly to the base body 7 by means of weld seams P. For each combing element K1 through K3, the clothing elements N1 through N3, respectively, are situated next to one another according to the illustration in FIG. 4. The weld seams shown in FIG. 5 (produced by laser welding, for example) also extend over the width L of the base body. At their rear end, the front clothing elements N1 are provided with a stepped offset 20 which protrudes beyond a likewise stepped projection 22 of the subsequent clothing elements N2. The projection 22, having a projection dimension "k", protrudes into the free space of the stepped offset 20, and in the radial direction is held on the circumferential surface U of the base body 7 by the lower face 21 of the stepped offset. A distance "m" is provided between the inner face 19, and the end face 23 of the projection 22. A weld seam P which joins the clothing elements N1 to the base body 7 is applied within the free space thus formed.

On the end opposite from the projection 22, the clothing elements N2 of the combing element K2 are provided with an offset 20 which overlaps a projection 22 of the subsequent clothing elements N3. Here as well, as shown and described for the clothing elements N1 and N2, a distance m is present between an inner face 19 of the offset 20 and an end face 23 of the projection 22. A weld seam between the inner faces 19 of the clothing elements N2 and the circumferential surface U of the base body 7 is applied in the free space thus formed.

Figure 5A:
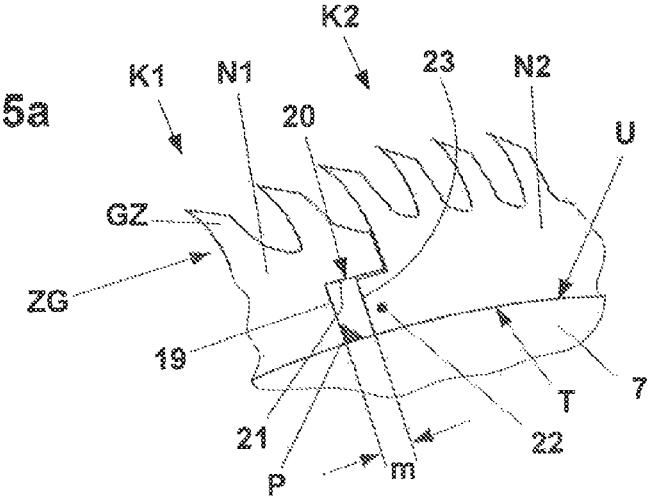
FIG. 5*a* shows an enlarged partial view according to FIG. 5.

The projection 22 of the clothing elements N3 in the radial direction is also fixed and held by the offsets 20 of the clothing elements N2. The clothing elements N3 of the combing element K3 are fastened at the opposite end of the projection 22 by means of a weld seam P. FIG. 5*a* shows an enlarged view of the configuration of the ends, and of the connection thereof to the clothing elements. In this design as well, a closed comb surface with no interruption is obtained. The clothing elements may be attached to the base body in a simple and cost-effective manner. The clothing elements are attached in the sequence K1, K2, and K3 corresponding to the overlap of the ends between the clothing elements N1 through N3. This means that, first of all, the clothing elements N1 of the first combing element K1 are lined up on the base body 7 (corresponding to the illustration according to FIG. 4) and joined to the base body 7 in the area of their ends (as shown) by means of the weld seams P, for example via a laser weld seam. The clothing elements N2 are subsequently placed on the circumferential surface U of the base body 7, and with their projections 22 are pushed beneath the face 21 of the offset 20 of the clothing elements N1. These clothing elements are then joined to the base body at the end facing the clothing elements N2 by means of a weld seam P. The clothing elements N3 are subsequently placed on the circumferential surface U of the base body 7, and with their projections 22 are pushed beneath the face 21 of the offset 20 of the clothing elements N2. Lastly, the clothing elements N3 at the end facing the projection 22 are joined to the base body 7 by means of a weld seam P.

The invention claimed is:

1. A combing element for a circular comb of a combing machine, the combing element connectable to a base body of the circular comb, comprising:

a plurality of adjacently situated clothing elements oriented transversely relative to a longitudinal direction of the combing element, the clothing elements having a toothed clothing and a base surface opposite from the toothed clothing;

a mounting bar having lateral faces and a supporting surface on which the base surface of the clothing elements rest;

the clothing elements further comprising longitudinal ends that protrude beyond the lateral faces of the mounting bar; and the clothing elements joined to the mounting bar with at least one weld seam applied between the base surface of at least one of the protruding longitudinal ends of the clothing elements and the mounting bar.

2. The combing element as in claim 1, wherein a weld seam is applied between the base surface of both of the protruding longitudinal ends of the clothing elements and the mounting bar.

3. The combing element as in claim 2, wherein the weld seams extend continuously in the longitudinal direction of the mounting bar.

4. The combing element as in claim 1, wherein the weld seam comprises a laser-welded seam.

5. The combing element as in claim 1, wherein the mounting bar further comprises a positive-fit mounting profile defined on a surface thereof opposite from the supporting surface, the positive-fit mounting profile providing for a positive-fit connection with a complimentary profile on the circular comb.

6. The combing element as in claim 5, wherein the positive-fit profile comprises a dovetail-shaped profile.

7. The combing element as in claim 1, wherein the mounting bar further comprises a longitudinal groove defined in a surface thereof opposite from the supporting surface, the longitudinal groove providing a positive-fit connection with a fastener used to connect the mounting bar to the circular comb.

8. The combing element as in claim 7, wherein the positive-fit profile comprises a dovetail-shaped profile.

9. A circular comb for a combing machine, comprising:

a base body;

a plurality of combing elements mounted to the base body and situated one behind the other relative to a rotational direction of the circular comb, each of the combing elements further comprising:

a toothed clothing and a base surface opposite from the toothed clothing;

a mounting bar having lateral faces and a supporting surface on which the base surface of the clothing elements rest;

longitudinal ends that protrude beyond the lateral faces of the mounting bar; and the clothing elements joined to the mounting bar with at least one weld seam applied between the base surface of at least one of the protruding longitudinal ends of the clothing elements and the mounting bar.

10. The circular comb as in claim 9, wherein a weld seam is applied between the base surface of both of the protruding longitudinal ends of the clothing elements and the mounting bar.

11. The circular comb as in claim 10, wherein the weld seams extend continuously in the longitudinal direction of the mounting bar.

12. The circular comb as in claim 9, wherein the weld seam comprises a laser-welded seam.

13. The circular comb as in claim 9, wherein the mounting bar further comprises a positive-fit mounting profile defined on a surface thereof opposite from the supporting surface, the base body having a complimentary profile defined therein wherein a positive-fit connection is established by insertion of the positive-fit mounting profile on the mounting bar into the complimentary profile on the base body of the circular comb.

14. The circular comb as in claim 13, wherein the positive-fit mounting profile and complimentary profile comprises a dovetail-shaped profile.

15. The circular comb as in claim 9, wherein the mounting bar further comprises a longitudinal groove defined in a surface thereof opposite from the supporting surface, the longitudinal groove providing a positive-fit connection with a fastener used to connect the mounting bar to the circular comb.

16. The circular comb as in claim 15, wherein the positive-fit profile comprises a dovetail-shaped profile.

17. A circular comb for a combing machine, comprising:

a base body;

a plurality of combing elements mounted to the base body and situated one behind the other relative to a rotational direction of the circular comb, each of the combing elements further comprising:

a toothed clothing and a base surface opposite from the toothed clothing;

a mounting bar having lateral faces and a supporting surface on which the base surface of the clothing elements rest;

opposite longitudinal ends such that mutually facing longitudinal ends are configured between adjacent combing elements;

the clothing elements joined to the mounting bar with at least one weld seam applied between the base surface of at least one of the longitudinal ends of the clothing elements and the mounting bar; and an overlapping stepped offset profile defined between the mutually facing longitudinal ends of adjacent combing elements, the overlapping stepped profile defining a closed clothing surface between the adjacent combing elements.

18. The circular comb as in claim 17, wherein the overlapping stepped offset profile includes an overhang on one of the combing elements that extends circumferentially over a complimentary offset on the adjacent combing element such that a space (m) is defined between the complimentary offset and the longitudinal end of the adjacent combing element, the weld seam provided in the space (m).

* * * * *